United States Patent [19]

Stewart, Jr.

[11] Patent Number: 4,547,011

[45] Date of Patent: Oct. 15, 1985

[54] SNO-RAK

[76] Inventor: Isaac Stewart, Jr., 71 Sheridan St. NE., Washington, D.C. 20011

[21] Appl. No.: 698,237

[22] Filed: Feb. 5, 1985

[51] Int. Cl.[4] ..... B05B 7/02

[52] U.S. Cl. ..... 294/54.5

[58] Field of Search ..... 294/54.5, 55, 57, 58; 37/122, 123, 130

[56] References Cited

U.S. PATENT DOCUMENTS 1,066,562 7/1913 Wilkins ..... 294/54.5

FOREIGN PATENT DOCUMENTS 1045763 9/1979 Canada ..... 294/54.5

*Primary Examiner*—James B. Marbert

[57] ABSTRACT

Conventional, it is usual to try and clear snow and the like from porches, sidewalks and walkways with snow shovels and other regular types of shovels. This lifting of snow has proven to be one of the major causes of backaches, heart attacks and the like. A Sno-Rak can prevent serious back injuries and other related health problems due to lifting. It has a triangular shaped heavy metal plane consisting of sixteen gauge weight. A one-inch fin is located at the outer edge of the metal plane at a one hundred five degree angle. At the upper end is a tubular ferrule for attaching a handle. Therefore, snow can be removed without the necessity of heavy lifting.

1 Claim, 3 Drawing Figures

SNO-RAK

BACKGROUND OF THE INVENTION

Fan shaped rakes have long been used for raking leaves, grass and other debris.

Accordingly, there is a need for raking snow. The conventional hand tools used for cleaning snow off sidewalks, driveways, porches and steps requires lifting and/or pushing the snow. This can often lead to serious injuries or other serious health problems such as heart attacks, strokes and back problems. However, a fan-shaped, sixteen gauge solid steel metal rake with a one inch fin, the snow can be removed by raking, lessing the chances of a back injury because of lifting.

BRIEF DESCRIPTION OF THE INVENTION

The Sno-Rak of the instant invention is fan shaped which diverge slightly toward the free end thereof. The improvement comprising the Sno-Rak is shaped similiarly to the conventional, fan shaped rake used for raking leaves. With the exception, when a handle is attached to tubular ferrule, it can be used for raking snow.

The Sno-Rak consists of a triangular shaped solid steel metal that flares inward at break between one inch fin and fan shaped flare. This one inch fin bends downward from the fan shaped flare on a one hundred five degree angle.

DETAILED DESCRIPTION OF THE INVENTION

Figure 1:
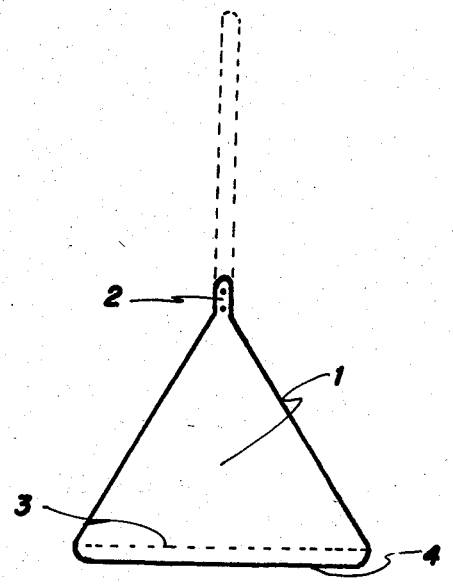
FIG. 1 is a vertical sectional view.
Figure 2:
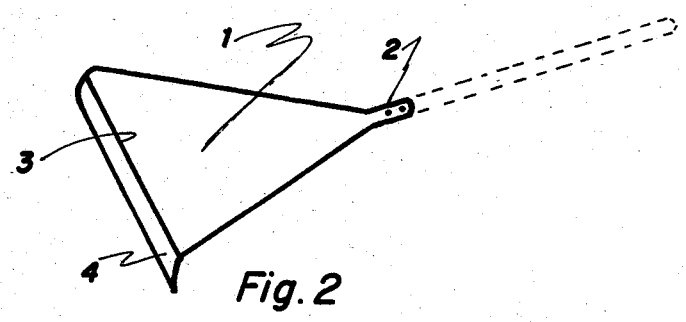
FIG. 2 is a perspective view of a fan-type rake head constructed in accordance with the present invention.
Figure 3:
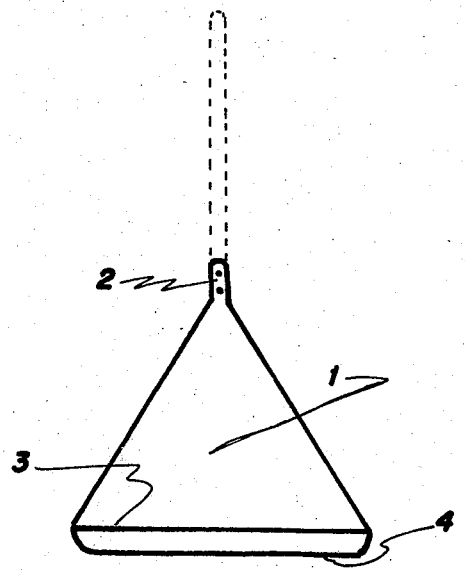
FIG. 3 is a view of the underside portion of the rake head.

Referring now more specifically to the drawings the numeral 2 general designates a rake constructed in accordance with the present invention. The first end 2 has a tapered tubular ferrule secured thereon supporting a triangular shaped solid plane composed of sixteen gauge steel metal 1 that flares inward at break 3 between one inch fin 4 which also consists of sixteen gauge steel metal. The fin 4 bends downward at break 3 on seventy to seventy-five degree angle.

The foregoing may be considered as a descriptive of a conventional rake. The rake 1 distinguishes from a conventional rake in that it consists of solid sixteen gauge steel metal that flares in at break 3 between one inch, sixteen gauge fin 4. Thus, the ability to rake snow.

The foregoing is considered as illustrative only of the principals of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A Sno-Rak or tool used for removing snow from flat, horizontal surfaces such as steps, porches and sidewalks as the user stands above it, the combination comprising:

a. a straight triangular shaped raking plate;

b. a fin integral with the outer edge of the plate, said fin breaks on an angle at one hundred five degrees from the plane of the plate, enabling the tool to bite, grip and hold an area of snow to be removed during the raking process;

c. a tubular ferrule in integral with the upper end of said plate for permanently attaching a handle;

d. the plate is located between the fin and the ferrule which enables the user to remove snow in manageable amounts; and e. said plate consists of sixteen gauge metal.

* * * * *